US009147390B2

(12) United States Patent
Swinkels et al.

(10) Patent No.: US 9,147,390 B2
(45) Date of Patent: Sep. 29, 2015

(54) OPTICAL ACOUSTIC PANEL

(71) Applicant: KONINKLIJKE PHILIPS N.V., Eindhoven (NL)

(72) Inventors: Stefan Henricus Swinkels, Valkenswaard (NL); Michel Cornelis Josephus Marie Vissenberg, Roermond (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/352,736

(22) PCT Filed: Sep. 25, 2012

(86) PCT No.: PCT/IB2012/055096

§ 371 (c)(1),
(2) Date: Apr. 18, 2014

(87) PCT Pub. No.: WO2013/057610

PCT Pub. Date: Apr. 25, 2013

(65) Prior Publication Data

US 2014/0299408 A1 Oct. 9, 2014

Related U.S. Application Data

(60) Provisional application No. 61/549,299, filed on Oct. 20, 2011.

(51) Int. Cl.
*E04B 1/84* (2006.01)
*G10K 11/16* (2006.01)
(Continued)

(52) U.S. Cl.
CPC ..... *G10K 11/16* (2013.01); *F21V 33/006* (2013.01); *G10K 11/172* (2013.01); *E04B 1/8409* (2013.01); *E04B 1/86* (2013.01); *E04B 2001/748* (2013.01); *F21V 11/14* (2013.01)

(58) Field of Classification Search
CPC ..... E04B 1/84
USPC ..... 181/289, 284
See application file for complete search history.

(56) References Cited

U.S. PATENT DOCUMENTS
2,850,110 A * 9/1958 Benjamin ..... 181/289
2,870,857 A * 1/1959 Goldstein ..... 181/289
(Continued)

FOREIGN PATENT DOCUMENTS
EP 2008805 A1 12/2008
WO 2006008070 A1 1/2006
WO 2012140579 A2 10/2012

OTHER PUBLICATIONS
Fuchs, Helmut V. Etal "Micro-Perforated Structures as Sound Absorbers—A Review and Outlook", ACTA Acustica United With Acustica, vol. 92, No. 1, 2006, pp. 139-146.
(Continued)

*Primary Examiner* — Forrest M Phillips

(57) ABSTRACT

An optical acoustic panel 100 for absorbing sound and providing a daylight appearance and a luminaire are provided. The optical acoustic panel 100 comprises a first side 114, a second side 104, a micro perforated foil 110 and a spacing structure 108. The first side 114 receives sound. The second side 104 is opposite the first side 114 and receives light. The micro perforated foil 110 comprises sub-millimeter holes 112, is light transmitting and is arranged at the first side 114. The sub-millimeter holes 112 are entrance holes of a cavity. The spacing structure 108 spaces the first side 114 at a predefined distance from the second side 104. The spacing structure 108 comprises a plurality of light transmitting cells 106. The light transmitting cells 106 comprise a light transmitting channel 118, a light exit window 122, a light input window 120 and a wall 116. The light transmitting channel 118 collimates a part of the light received at the second side 104 of the optical acoustic panel 100. The light transmitting channels 118 extend from the first side 114 towards the second side 104 and are filled with air. The light input window 120 is arranged at the second side 104. At least a part of the light exit window 122 being arranged at the first side 114. The wall 116 is interposed between the light input window 120 and the part of the light exit window 122. The wall 116 encloses the light transmitting channel 118. At least a part of the wall 116 being reflective or transmissive in a predefined spectral range for obtaining a blue light emission at relatively large light emission angles with respect to a normal to the first side 114.

12 Claims, 9 Drawing Sheets

(51) Int. Cl.

| | |
|---|---|
| ***G10K 11/172*** | (2006.01) |
| ***F21V 33/00*** | (2006.01) |
| *E04B 1/86* | (2006.01) |
| *E04B 1/74* | (2006.01) |
| *F21V 11/14* | (2006.01) |

(56) References Cited

U.S. PATENT DOCUMENTS

| | | | | | |
|---|---|---|---|---|---|
| 2,966,954 | A * | 1/1961 | Sabine | 181/289 |
| 2,978,571 | A * | 4/1961 | Rosenblatt | 362/149 |
| 4,829,728 | A * | 5/1989 | Castelli | 52/145 |
| 5,532,440 | A * | 7/1996 | Fujiwara | 181/289 |
| 5,942,736 | A * | 8/1999 | Cortonesi | 181/289 |
| 6,351,914 | B1 * | 3/2002 | Sobek | 52/145 |
| 7,021,421 | B2 * | 4/2006 | Ohmori et al. | 181/289 |

OTHER PUBLICATIONS

Maa, Dah-You "Potential of Microperforated Panel Absorber", Journal Acoustical Society of America, vol. 104, No. 5, Nov. 1998.

* cited by examiner

OPTICAL ACOUSTIC PANEL

CROSS-REFERENCE TO PRIOR APPLICATIONS

This application is the U.S. National Phase application under 35 U.S.C. §371 of International Application No. PCT/IB2012/055096, filed on Sep. 25, 2012, which claims the benefit of U.S. Provisional Patent Application No. 61/549,299, filed on Oct. 20, 2011. These applications are hereby incorporated by reference herein.

FIELD OF THE INVENTION

The invention relates to the field of optical acoustic panels.

BACKGROUND OF THE INVENTION

Micro perforated foils are used in specific acoustic panels. The acoustic panels provide a sound absorbing effect based on Helmholtz resonant sound absorption when the micro perforated foils are used in combination with a space behind the micro perforated foil. Such acoustic panels are, for example, discussed in "*Micro-Perforated Structures as Sound Absorbers—A review and Outlook*", by Helmut V. Fuchs, Xueqin Zha, published in Acta Acustica united with Acustica, Volume 92, No 1, January 2006, pp 13-146. The micro perforated foil is a foil in which a plurality of relatively small holes is provided. When two micro perforated foils are used, the two foils have to be separated from each other by a spacing structure. The spacing structure is arranged to provide an air gap between the micro perforated foils. Relatively large panels may be created by combining a spacing structure that extends along a relatively large area with two micro perforated foils on both sides of the spacing structure. If the micro perforated foils are transparent or translucent, and the spacing structures do not obstruct the light, light may be transmitted through the acoustic panel, which results in an optical acoustic panel. The optical acoustic panel may be provided at any location in rooms or relatively large open spaces such that sound is absorbed and such that light emitted by a light emitter, or light received via a window, is not obstructed by the optical acoustic panel.

Although the known optical acoustic panels provide a relatively good sound absorption and provide a relatively good light transmission, the person present in the space in which the optical acoustic panel is provided mainly benefits from the acoustic characteristics of the optical acoustic panel compared to a situation without an optical acoustic panel. The optical characteristics of the optical acoustic panel influence the lighting conditions in the space to a limited extent.

Especially when the space in which the optical acoustic panel is provided does not contain windows through which daylight is received, the well-being of people who are frequently in the space is not positively influenced by the lighting conditions in the space. There is a need for means which influence the lighting conditions such that the persons, who are available in the space, experience the lighting conditions of the space as a lighting condition which is comparable to a situation in which daylight was received via a window or a skylight.

SUMMARY OF THE INVENTION

It is an object of the invention to provide an optical acoustic panel which, while absorbing sound in a space, also positively influences the well-being of people present in the space by influencing the lighting conditions in the space.

A first aspect of the invention provides an optical acoustic panel. A second aspect of the invention provides a luminaire. Advantageous embodiments are defined in the dependent claims.

An optical acoustic panel for absorbing sound and providing a daylight appearance in accordance with the first aspect of the invention comprises a first side, a second side, a micro perforated foil and a spacing structure. The first side receives sound. The second side is opposite the first side and receives light. The micro perforated foil comprises sub-millimeter holes, is light transmitting and is arranged at the first side. The sub-millimeter holes are entrance holes of a cavity. The spacing structure spaces the first side at a predefined distance from the second side. The spacing structure comprises a plurality of light transmitting cells. The light transmitting cells comprise a light transmitting channel, a light exit window, a light input window and a wall. The light transmitting channel collimates a part of the light received at the second side of the optical acoustic panel. The light transmitting channels extend from the first side towards the second side and are filled with air. The light input window is arranged at the second side of the optical acoustic panel. At least a part of the light exit window being arranged at the first side of the optical acoustic panel. The wall is interposed between the light input window and the part of the light exit window. The wall encloses the light transmitting channel. At least a part of the wall is reflective or transmissive in a predefined spectral range for obtaining a blue light emission at relatively large light emission angles with respect to a normal to the first side of the optical acoustic panel.

The sound absorbing characteristic of the optical acoustic panel is based on Helmholtz resonant sound absorption. Sound which is transmitted through relatively small holes which have a diameter in the sub-millimeter range, and which enters the cavity of a specific depth, is for a large extent not reflected by the optical acoustic panel and as such absorbed. The optical acoustic panel has at the first side the micro perforated foil which comprises the sub-millimeter range holes and the optical acoustic panels has a cavity of a specific depth, namely, seen in a direction from the ambient towards the first side, the cavity is behind the micro-perforated foil and has a minimum depth that is defined by the spacing structure. The depth of the cavity influences the sound absorption characteristics of the optical acoustic panel. The light transmitting channels extend from the first side to the second side and are filled with air, and, as such, they have not limit the specific depth of the cavity. The spacing structure is acoustically neutral. The spacing structure is provided for keeping a minimal distance between the first side and the second side and to provide mechanical strength to the optical acoustical panel.

The spacing structure further has an optical function. The spacing structure comprises a specific configuration to change the light emission distributions that is received at the second side into a daylight appearance light emission. The parts of the walls of the light transmitting cells that are blue reflective or blue transmissive convert light that is received at relatively large light emission angles (with respect to a normal to the first side) to bluish light. The blue light emission, depending on the specific characteristics of the walls, is at least emitted at relatively large light emission angles and may also be present at smaller light emission angles. Further, because of the blue light emission at relatively large light emission angles, a person, who is looking towards the first side of the optical acoustic panel from a direction resulting in a relatively large observation angle (measured with respect to the first side of the optical acoustic panel), sees a blue light emitting panel. Daylight comprises a relatively large amount of energy in the blue spectral range. If a person is not directly looking towards the sun, the sky has a blue appearance because most of the blue light of daylight is not emitted into the same direction as light directly originating from the sun. Further, the light transmitting channel is a channel through which light, which follows a path along an unobstructed straight line through the channel, is transmitted in the same spectral light emission distribution as the light which is received at the second side of the optical acoustic panel. Thus, the emission received at the second side of the optical acoustic panels is collimated into an angular light emission distribution which is smaller. Especially, if substantially white light is received at the second side, the collimated light beam comprises white light which is comparable to the appearance of direct sunlight.

The micro perforated foil which is provided at the first side is light transmitting, which means that light, which impinges on the micro perforated foil, is transmitted through the micro perforated foil. As such, the micro perforated foil transmits the collimated light and the bluish light at relatively large light emission angles. If the micro perforated foil is transparent, the best light transmission is obtained without changing light emission angles. If the micro perforated foil is diffuse and/or scatters light, it should be diffuse and scatter light to a limited extends to prevent that the collimated light beam becomes too wide and that too much bluish light is emitted at relatively small light emission angles. If the micro perforated foil is diffuse and/or scatters light, the FWHM angle of the collimated light beam should not be increased with more than 20 degrees.

Consequently, sound is absorbed at the first side of the optical acoustic panel, and light is emitted through the light transmitting micro perforated foil which comprises blue light at least at relatively large light emission angles and comprises white light within a collimated light beam. Such a light emission is experienced by people as the daylight of a sunny day, and, thus, the optical acoustic panel converts the received light to artificial daylight. Providing the optical acoustic panels at walls or at a ceiling of a room creates the impressions that a large window or skylight is available in the respective walls or ceiling for persons being present in the room. Consequently, the well-being of the person in the room is improved. It has been proven in different studies that, if people receive within building daylight, their well-being increases, as well as their efficiency and productivity.

It is to be noted that the optical acoustic panels may be provided directly in front of light sources, which means that the optical acoustic panel may be coupled to a luminaire comprising the light sources and a surface of the luminaire closes the cavity. In such situations the size of the optical acoustic panel is most probably determined by the size of the luminaire. In other optional embodiments, the optical acoustic panels are arranged at some distance away from one or more light sources, or at some distance away from a skylight or window. If the optical acoustic panel is not directly in contact with a luminaire, a light transmitting plate or another micro perforated foil has to close the cavity at the second side of the optical acoustic panel. In such arrangements the size of the optical acoustic can be relatively large resulting in a better daylight experience because of the relatively large panel.

The holes have a size in the sub-millimeter range, which means that their diameter is smaller than 1 millimeter. If the size of the holes is in this range, the absorption of sound is relatively high in a relatively wide spectrum. For comparison: if larger holes are used the absorption distribution shows a relatively narrow peek around a specific frequency.

Seen from an acoustic point of view, the light transmitting cells only provide the function of a cavity in which sound may resonate. Mainly the depth of the cavity (measured in a direction from the first side to a surface which closes the cavity) influences the absorption characteristic of the optical acoustic panel. Because, seen from an acoustic point of view, the diameter of the cavity is not related to the absorption effect of the optical acoustic panel, a single light transmitting cell may be arranged behind one or more sub-millimeter holes of the micro perforated foil. Other points of view determine the diameter of the light transmitting channels and/or the thickness of the walls in between the light transmitting channels.

Seen from a mechanical point of view, the spacing structure is the (rigid) body of the optical acoustic panel and provides mechanical strength to the optical acoustic panel. Especially when the diameter of the light transmitting cells becomes too wide, or when the walls of the light transmitting cells become too thin, the mechanical strength of the spacing structure reduces too much thereby limiting the size of optical acoustic panel.

From an optical point of view, the ratio between the diameter of the light transmitting channel and the length of the light transmitting channel determines the amount of collimation of the light received at the second side of the optical acoustic panel, and a range of light emission angles at which mainly blue light is emitted.

Optionally, the optical acoustic panel comprises a further micro perforated foil comprising sub-millimeter holes. The further micro perforated foil is light transmitting and is arranged at the second side. In other words, the further micro perforated foil is the closing means with the surface which closes the cavity between the first side and the surface. The spacing structure keeps the predefined distance between the two micro perforated foils that are used in the optical acoustic panel. It has been found that the sound absorbing characteristic of the optical acoustic panel increases when the second side has also such a micro perforated foil (compared to a situation where at the second side a plate or foil is used to close the cavity). The further micro perforated foil is light transmitting, and, thus, it may be transparent of diffuse. Because the further micro perforated foil is provided at the light receiving side of the optical acoustic panel, no limitations with respect to the degree of diffuseness of the further micro perforated foil exist.

Optionally, a distance between first side and a surface that closes the cavity, measured along a line perpendicular to the first side, is in a range 1 to 10 centimeter. It has been found that, if the cavity depth (measured along the normal to the first side) has a value in the range from 1 to 10 centimeter, the sound absorption is relatively good. The surface which closes the cavity is arranged at or near the second side of the optical acoustic panel. An additional distance may be present between the surface which closes the cavity and the second side of the optical acoustic panel, however, the length of the light transmitting channels plus this additional distance should be within the range from 1 to 10 centimeters.

Optionally, a diameter of the sub-millimeter holes of the micro perforated foil has a value that is within a 15% deviation interval from the thickness of the micro perforated foil and/or the diameter of the sub-millimeter holes of the further micro perforated foil has a value that is within a 15% deviation interval from the thickness of the further micro perforated foil. Having the value with the 15% deviation interval means that the value of the diameter may deviate 15% (upwards and downwards) from the thickness of the foil. It has been found that, if the diameter of the sub-millimeter hole is about the same value as the thickness of the micro perforated foil, the sound absorption is relatively good.

Optionally, a ratio between the total area of the micro perforated foil and the area of the sub-millimeter holes of the micro perforated foil is smaller than 0.1 and a further ratio between the total area of the further micro perforated foil and the area of the sub-millimeter holes of the further micro perforated foil is smaller than 0.1. In other words, not more than 10% of the surface of the (further) micro perforated foil is a hole. This provides an advantageous trade-off between mechanical strength of the micro perforated foil and the acoustic properties (absorption of sound) of the optical acoustic panel.

Optionally, a first part of the wall of the light transmitting cells is reflective or transmissive in the predefined spectral range in an area from the second side of the optical acoustic panel along a specific distance towards the first side of the optical acoustic panel to obtain a substantial blue light emission at light emission angles larger than 60 degrees. The light emission angles are measured with respect to the normal to the first side of the optical acoustic panel. A second part of the walls is transparent. The second part is different from the first part. Thus, seen in a direction from the second side towards the first side, the walls are first blue reflective or blue transmissive and after that transparent. The walls may be made blue reflective by a blue paint. The walls may be made blue transmissive by arranging a light transmitting cell with a blue transmissive wall in series with a light transmitting cell having a transparent wall. The effect of the arrangement is that at relatively large light emission angles only blue light is emitted, which is experienced by users as less glary light than the light that is received by the light input windows of the light transmitting sides. Thus, as the optical acoustic panel is used at a ceiling, of for example an office, the desks are lightened by a pleasant light beam of white light and persons, who look towards the optical acoustic panel, see a blue light emitting surface as if it is a blue sky (people mostly look at an angle that is larger than 60 degrees towards light sources/luminaires).

Optionally, the light transmitting cells being arranged in a raster structure and a thickness of the walls is smaller than ⅓ of a pitch of the raster structure. The pitch of the raster structure is defined by the shortest distance from a center point of a light transmitting channel to a center point of a neighboring light transmitting channel, and the thickness of the wall is defined as the shortest distance from a surface of the wall facing towards the light transmitting channel to another surface of the wall facing towards the neighboring light transmitting channel. An edge of the wall at the side of the light input window of the light transmitting cells blocks a part of the light which is received at the second side. The light which impinges on the edges is not transmitted into the light transmitting channel of the light transmitting cells and, as such, not emitted through the light exit windows of the light transmitting cells. This contributes to an inefficiency of the optical acoustic panel. By keeping the ratio between the thickness of the wall and the pitch of the raster structure smaller than ⅓, the inefficiency is kept within acceptable boundaries. Further, another edge (at the first side of the optical acoustic panel) is visible to a viewer. The visible edge of the walls may disturb a uniform daylight appearance. As such it is advantageous to keep the thickness of the walls within acceptable limits.

Optionally, the thickness of the walls is smaller than ⅕ of the pitch of the raster structure. This results in a higher efficiency and a better skylight appearance. In another option, the thickness of the walls is smaller than 1/10 of the pitch of the raster structure, which results in even better advantageous effects.

Optionally the optical spacing structure comprises a stretched-out stack of elongated layers. Pairs of successive layers are joined together at a plurality of points. Successive pairs of successive layers are joined together at different points. The layers form the walls of light transmitting channels. The light transmitting channels are formed by spaces between two successive layers of the stretched-out stack of elongated layers. The point-wise joining of layers may be carried out by gluing. Such a spacing structure may be manufactured very efficiently. Elongated stripes of a blue material are successively glued together such that the glue-points of successive pairs of successive layers are different in a direction following the elongated layer, and after the gluing, the stack of elongated layers is stretched-out to obtain the spacing structure. Further, besides the fact that such a structure may be manufactured efficiently, the optional features may result in further benefits in the distribution and storages of the spacing structure. Namely, it is not necessary to stretch out the stack of layers immediately after gluing the layers together. This may also be performed just before the micro perforated foil is arranged to the first side of the spacing structure. Thus, after gluing the layers together, the stack may be stored or distributed in its most compact shape.

Optionally, a surface of the walls facing towards the light transmitting channel is diffusely reflective in the predefined spectral range. Such a wall reflects the light which impinges on the wall back towards the light transmitting channel, and because the wall is blue, blue light is reflected back. Most of this reflected light will exit the light transmitting channel via the light exit window, either directly or after one or more additional reflections. Furthermore, a diffusely reflective side of the wall results in an advantageous spreading of light emission angles of the bluish light. Walls having this characteristic may be manufactured of a large set of materials. Just two possible examples are: a plastic with a blue dye, or a metal on which a blue reflective or blue diffusely reflective coating is applied.

Optionally, the walls are light transmitting in the predefined spectral range. If light impinges on the walls and is transmitted through the (blue) walls, the light output of the optical element at relatively large light emitting angels comprises light that passed the light transmitting walls and is consequently more blue (more saturated blue). As such it contributes to the daylight appearance. Several materials may be used, like blue transparent synthetic materials. If a plurality of light transmitting cells is arranged in a raster structure, and if a user views towards the optical acoustic panel comprising the spacing structure with blue light transmitting walls, the bluish light becomes more (saturated) blue at larger viewing angles. Light impinges on the walls at relatively large light emission angles with respect to a normal axis of the light input window, and is transmitted more than once through several blue light transmitting walls of successive light transmitting cells and as such the blue color is intensified at every passage of such a wall. This effect is experienced by user as a pleasant daylight appearance of the optical acoustic panel.

Optionally, a ratio between a diameter of the light transmitting channel and a length of the light transmitting channel is smaller than 3.4. The diameter of the light transmitting channel is defined as an average of the length of all possible imaginary straight lines through a centre point of the light transmitting channel from a point at the wall to another point at the wall along an imaginary plane parallel to the light input window. The length of the light transmitting channel is defined as an average of distances between the light input window and the light exit window measured along lines being parallel to the wall. To prevent too much glare, not too much light should be emitted at light emission angles which are larger than 60 degrees (for example, less than 1000 nits or candela per square meter). If the ratio is larger than 3.4, the light which is emitted at the center of the light exit window of the light transmitting cells has a cut-off angle at 60 degrees. The cut-off angle gradually increases towards 74 degrees at the border of the light exit window. Hence, glare is prevented. It is to be noted that the light emission at relatively large light emission angles also depends on the characteristics of the light that is received at the second side of the optical acoustic panel. If the received light comprises only a minor amount of light at relatively large light emission angles, not much light falls on the walls. If the received light comprises a substantial amount of its energy at relatively large light emission angles, the walls will reflect, in relative terms, much more light. For completeness, it is to be noted that still blue light is emitted at light emission angles larger than 60 degrees—however, the blue light is less glary light.

According to a second aspect of the invention a luminaire is provided which comprises the optical acoustic panel according to the first aspect of the invention. The optical acoustic panel is coupled to the luminaire and the second side of the optical acoustic panel is facing the luminaire. A surface of the luminaire closes the cavity. The luminaire according to the second aspect of the invention provides the same benefits as the optical acoustic panel according to the first aspect of the invention and has similar embodiments with similar effects as the corresponding embodiments of the optical acoustic panel.

Optionally, a shortest distance between the first side of the optical acoustic panel and a surface of the luminaire which closes the cavity is in a range from 1 to 10 centimeter. If the distance between the micro perforated foil which is arranged at the first side and the surface of the luminaire which closes the cavity is in the range from 1 to 10 centimeters, the absorption of sound is advantageous. The specific distance of this option is the depth of the cavity. Optionally, the micro perforated foil arranged at the first side of the optical acoustic panel is arranged parallel to the surface of the luminaire which closes the cavity.

In an embodiment, an optical acoustic panel for absorbing sound and providing a daylight appearance is provided. The optical acoustic panel comprises i) a first side for receiving sound, ii) a second side for receiving light, the second side being opposite the first side, the second side being configured to be coupled to a means comprising a surface for closing a cavity between the first side and the surface, iii) a micro perforated foil comprising sub-millimeter holes, the micro perforated foil being transparent and being arranged at the first side, and iv) a spacing structure for spacing the first side at a predefined distance from the second side, wherein the spacing structure comprises a plurality of light transmitting cells, the light transmitting cells comprise (a) a light transmitting channel for collimating a part of the light received at the second side of the optical acoustic panel, the light transmitting channels extend from the first side towards the second side and are filled with air, (b) a light input window arranged at the second side of the optical acoustic panel, (c) a light exit window, at least a part of the light exit window being arranged at the first side of the optical acoustic panel, and (d) a wall interposed between the light input window and the part of the light exit window, the wall enclosing the light transmitting channel, at least a part of the wall being reflective or transmissive in a predefined spectral range for obtaining a blue light emission at relatively large light emission angles with respect to a normal to the first side of the optical acoustic panel.

These and other aspects of the invention are apparent from and will be elucidated with reference to the embodiments described hereinafter.

It will be appreciated by those skilled in the art that two or more of the above-mentioned options, implementations, and/or aspects of the invention may be combined in any way deemed useful.

Modifications and variations of the system, the method, and/or of the computer program product, which correspond to the described modifications and variations of the system, can be carried out by a person skilled in the art on the basis of the present description.

Figure 1A:
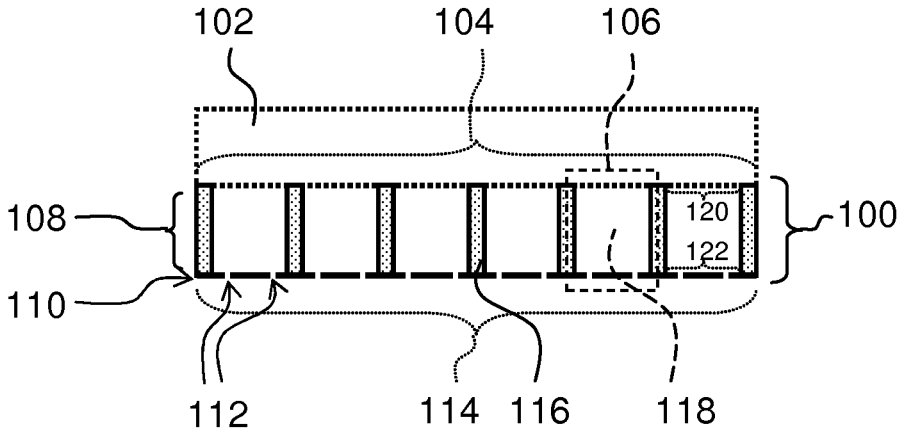
FIG. 1*a* schematically shows a cross-section of an embodiment of the optical acoustic panel according to the first aspect of the invention, FIG. 1*b* schematically shows a cross-section of another embodiment of the optical acoustic panel, FIG. 2 schematically presents, in a cross-sectional view, effects obtained by the optical acoustic panel according to the first aspect of the invention, FIG. 3 schematically shows, in a cross-section of the optical acoustic panel, different characteristics of the optical acoustic panel, FIG. 4*a* schematically shows a cross-section of an embodiment of a light transmitting cell having blue transparent walls, FIG. 4*b* schematically shows a cross-section of another embodiment of a light transmitting cell having walls comprising a blue transparent section and a transparent section.

It should be noted that items denoted by the same reference numerals in different Figures have the same structural features and the same functions, or are the same signals. Where the function and/or structure of such an item have been explained, there is no necessity for repeated explanation thereof in the detailed description.

The figures are purely diagrammatic and not drawn to scale. Particularly for clarity, some dimensions are exaggerated strongly.

DETAILED DESCRIPTION OF THE EMBODIMENTS

A first embodiment is shown in FIG. 1*a*. FIG. 1*a* schematically shows a cross-section of an embodiment of the optical acoustic panel 100 according to the first aspect of the invention. The optical acoustic panel 100 comprises a spacing structure 108 and a first micro perforated foil 110. The optical acoustic panel 100 has the first micro perforated foil 110 arranged at a first side 114 of the optical acoustic panel 100.

At a second side 104, being opposite the first side and being arranged parallel to the first side, the optical acoustic panel 100 is configured to be coupled to a means 102 which comprises a surface for closing a cavity between the first side and the surface. The means 102 is drawn schematically and may be a light source, a luminaire, or a transparent plate. A specific surface of the means 102 close the cavity, for example, the surface which is directly applied to the second side 104 of the optical acoustic panel 100, but, if the means does not have a surface directly coupled to the second side 104, it may also be another (inner) surface being arranged between the second side 104 and a back side of the means 102. In other figures the surface which closes the cavity is explicitly indicated.

The spacing structure 108 comprises a plurality of light transmitting cells 106, which comprise a light transmitting channel 118, a light input window 120 and a light exit window 122. The light transmitting channel 118 is arranged in between the first side 114 and the second side 104 and is arranged perpendicular to the first side 114. The light transmitting cells 106 further comprise walls arranged in between the light input window 120 and the light exit window 122, and, thus, the light transmitting channel 118 is enclosed by the walls 116. The light input window 120 receives light which is received at the second side 104 of the optical acoustic panel 100 and collimates a part of the received light to obtain a collimated light emission with the spectral characteristics of the received light. A part of the light that is received at the light input window 120 impinges on the walls 116. The walls 116 are reflective or transmissive in a predefined spectral range to obtain a blue light emission at relatively large light emission angles with respect to the normal to the firs side (the optical and acoustic effects are further explained in FIG. 2).

At the first side 114 of the optical acoustic panel 100 is arranged the first micro perforated foil 110 which comprises sub-millimeter holes 112 with a diameter in the sub-millimeter range. A combination of the micro perforated foil 110 and a surface, which closes the cavity, acts as a Helmholtz resonant sound absorber. The first side 114 of the optical acoustic panel 100 receives sound which enters, via the sub-millimeter holes 112, the cavity in between the surface of the means 102 and the first micro perforated foil 110 in which it causes a resonance. The sound is not reflected by the optical acoustic panel 100 and, thus, the sound is absorbed.

Figure 1B:
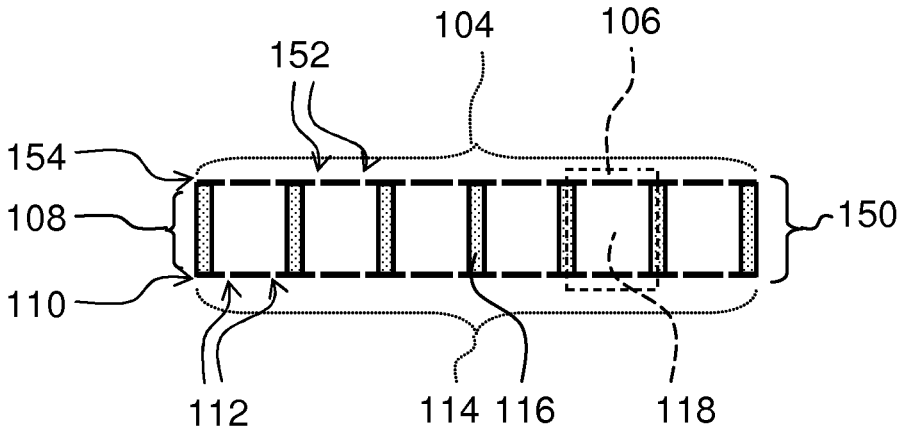

FIG. 1*b* schematically shows a cross-section of another embodiment of the optical acoustic panel 150. The optical acoustic panel 150 has a similar spacing structure 108 as optical acoustic panel 100 of FIG. 1*a*, and has a similar first micro perforated foil 110. At the second side 104 of the optical acoustic panel 150 is arranged a second micro perforated foil 154 which closes the cavity. The cavity extends from the first micro perforated foil 110 to the second micro perforated foil 154. The second micro perforated foil 154 has also sub-millimeter holes 152 having a diameter in the sub-millimeter range. The sizes of the respective sub-millimeter holes 112, 152 of the first micro perforated foil 110 and the second micro perforated foil 154 are not necessarily the same. Further, the distribution of the respective sub-millimeter holes 112, 152 along the first micro perforated foil 110 and the second micro perforated foil 154 is not necessarily the same. Further, FIG. 1*a* and FIG. 1*b* show that two sub-millimeter holes 112, 152 of each one of first micro perforated foil 110 and the second micro perforated foil 154 are arranged in front of the same light transmitting channel 118. However, in other embodiments the number of sub-millimeter holes per light transmitting channel 118 may differ. In yet a further embodiment, the number of sub-millimeter holes 112 of the first micro perforated foil 110 that are arranged in front of a specific light transmitting channel 118 differs from the number of sub-millimeter holes 152 of the second micro perforated foil 154 that are arranged in front of the specific light transmitting channel 118.

It has been found that the optical acoustic panel 150 according to the embodiment of FIG. 1*b* better absorbs sound than the optical acoustic panel 100 of FIG. 1*a*. Further, sound that is received by the second side 104 of the optical acoustic panel 150 of FIG. 1*b* is also absorbed.

The first micro perforated foil 110 and the second micro perforated foil 154 are drawn, in FIGS. 1*a* and 1*b*, as thick black lines. However, the use of black in the respective figures does not mean that the first micro perforated foil 110 and the second micro perforated foil 154 are opaque. Both the first and second micro perforated foils 110, 154 are transparent and allow the transmission of light through the micro perforated foils 110, 154. The first micro perforated foil 110 and the second micro perforated foil 154 are drawn as a black thick line to show the sub-millimeter holes more clearly.

The walls 116 have surfaces which reflect light in a predefined range such that a blue light emission is reflected by the walls 116. In another embodiment, the walls are transmissive in the predefined spectral range. If the walls are transmissive in the predefined spectral range, the light that is transmitted through the walls has after the transmission through the walls a blue color. It is to be noted that a blue light emission or a blue color means that the spectral energy of the light is concentrated in the blue spectral range, which means that more than 50% of the energy of the light is available at wavelengths in a range from 420 to 485 nm.

Figure 2:
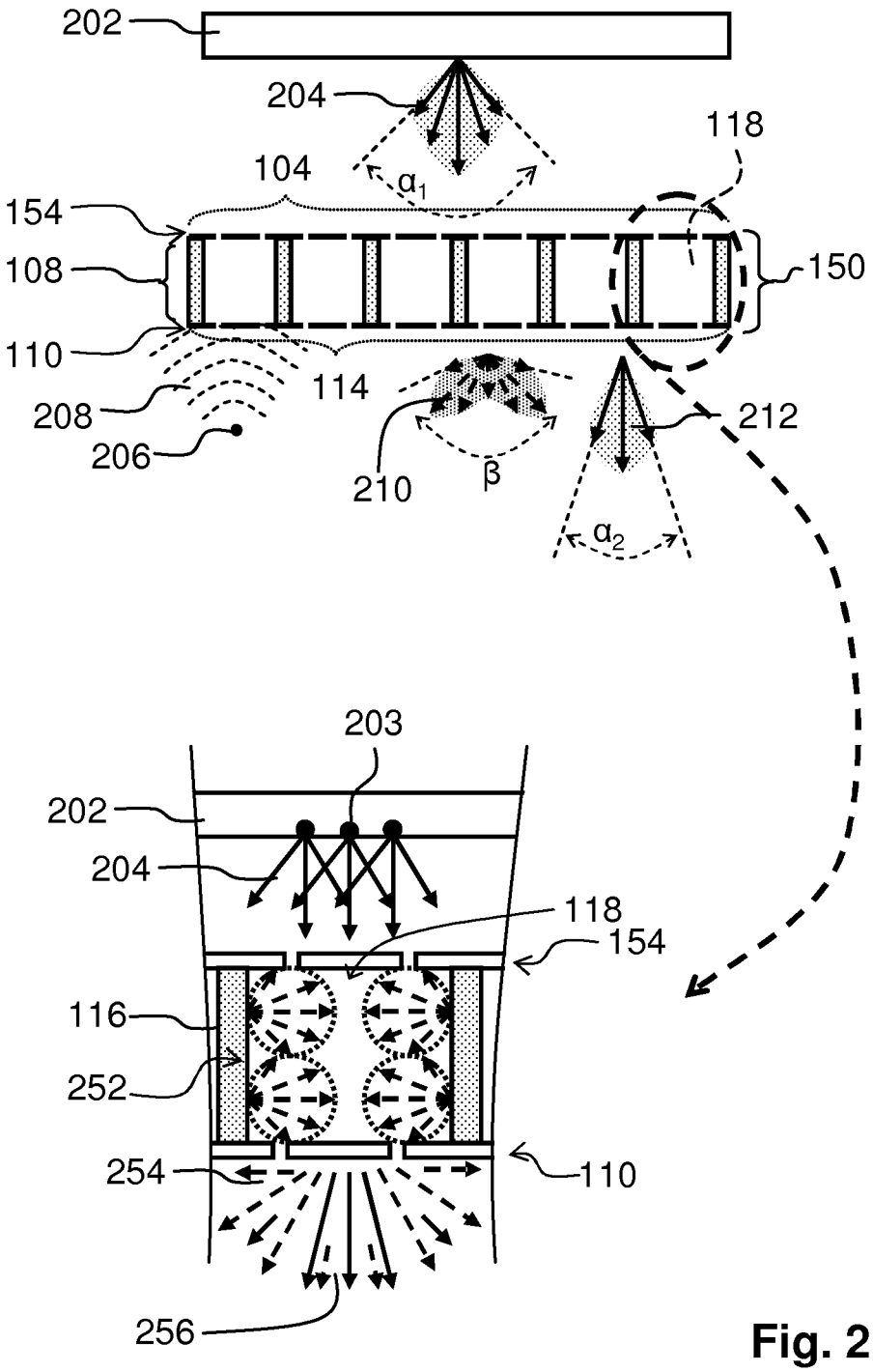

FIG. 2 schematically presents, in a cross-sectional view, effects obtained by the optical acoustic panel 150 according to the first aspect of the invention. The presented optical acoustic panel 150 is the optical acoustic panel that has been discussed in the context of FIG. 1*b*. At the bottom end of FIG. 2 an enlarged cross-section of one of the light transmitting channels 118 is presented.

At the second side 104 of the optical acoustic panel is received light, for example, for a light source 202 or a luminaire. In another embodiment daylight is received from a window. A light emission 204 of the light source 202 has a specific angular light emission distribution which has a maximum light emission angle $\alpha_1/2$ with respect to a central axis of the light emission 204. The light is transmitted through the transparent second micro perforated foil 154 into the light transmitting channels 118.

As shown at the bottom end of FIG. 2 the light source 202 has a relatively large light emission surface which may be modeled as a plurality of neighboring point light sources 203 which individually emit the specific light emission 204. Light enters the light transmitting channel 118 via the second micro perforated foil 154. A part of the received light is collimated by the light transmitting channel 118 and leaves the light transmitting channel 118 as a collimated light beam 212 which has a maximum light emission angle $\alpha_2/2$ which is smaller than the maximum light emission angle $\alpha_1/2$ of the light emission 204 of the light source 202. The spectral characteristics of the light emission 212 are equal to the spectral characteristics of light emission 204, because no specific color is absorbed while the light emission 204 is collimated to the collimated light beam 212.

A portion of the light which is received by the light transmitting channel 118 impinges on the walls 116 of the light transmitting cells. Surfaces 252 of the walls that face the light transmitting channel 118 have a blue color and are diffusely reflective. Diffusely reflective means that, if light rays impinge on the walls, they are reflected in a plurality of light emission directions. This is shown at the bottom end of FIG. 2. Points of the surfaces 252 act as Lambertian light source if light impinges on them—this is called Lambertian light reflection. The blue reflected light may leave the light transmitting channel 118 via the first micro perforated foil 110 directly after a single reflection, or after a plurality of reflections, by the walls 116 of the light transmitting channel 118. Thus, a blue light emission 210 is obtained having an angular light distribution as presented at the top end of FIG. 2. This angular light distribution is often called a batwing angular distribution. At a central axis not much blue light is emitted and at larger light emission angles with respect to the central axis of the light emission 210 more blue light is emitted. The maximum light emission angle $\beta/2$ is at least larger than the maximum light emission angle $\alpha_1/2$ of the light emission 204 that is received at the second side 104 of the optical acoustic panel 150. As shown at the bottom end of FIG. 2, the total light emission that leaves the light transmitting channel 118 through the first micro perforated boil 110 comprises a relatively large amount of light with the spectral characteristics of the light emission 204 at relatively small light emission angles 256, and comprises a relatively large amount of blue light at relatively large light emission angles 254.

It is further shown at the top end of FIG. 2 that sound 208 originating from a sound source 206 is received by the first side 114 of the optical acoustic panel 150. The sound is, to a large extent, transmitted through the sub-millimeter holes of the first micro perforated foil 110 into the cavity between the first micro perforated foil 110 and the second micro perforated foil 154. Based on the effect of Helmholtz resonant sound absorption, the sound is not transmitted back through the holes and is, thus, absorbed by the optical acoustic panel 150. The second side 104 of the optical acoustic panel 150 may also receive sound which is also absorbed via the sub-millimeter holes of the second micro perforated foil 154.

Figure 3:
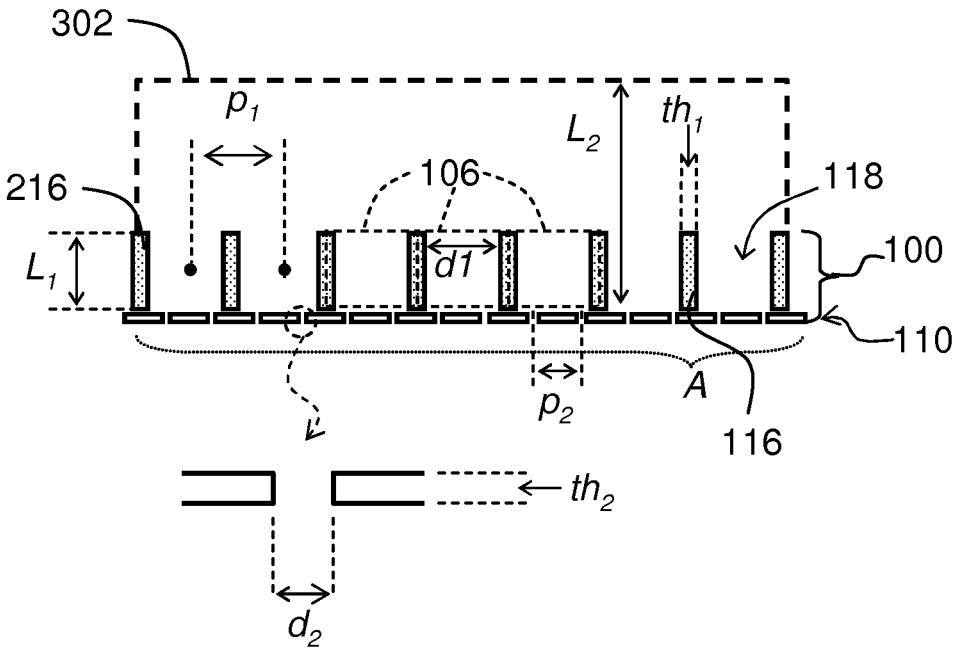

FIG. 3 schematically shows in a cross-section of the optical acoustic panel 100 different characteristics of the optical acoustic panel. Sub-millimeter holes of the first micro perforated foil 110 are arranged in an array at a hole pitch $p_2$. The micro perforated foil 110 has a thickness $th_2$ and the sub-millimeter holes have a hole diameter $d_2$. In an embodiment, the hole diameter $d_2$ is substantially equal to the thickness $th_2$ of the micro-perforated foil 110 such that the absorption spectrum of the optical acoustic panel 100 is relatively wide, however, in practical embodiments it is relatively difficult to obtain exactly the same size and a 15% deviation is allowed, in other words, $th_2 \cdot 0.85 \leq d_2 \leq th_2 \cdot 1.15$. Optionally, only a 10% deviation is allowed, in other words, $th_2 \cdot 0.9 \leq d_2 \leq th_2 \cdot 1.1$. The hole diameter $d_2$ is smaller than 1 millimeter.

The first micro perforated foil 110 has a total area A. The holes cover an area $A_h$ of the total area A. In an embodiment, a ratio between the area $A_h$ covered by the holes and the total area A is smaller than 0.1.

The same characteristics, as discussed in the previous two paragraphs, may apply to embodiments of the second micro perforated foil 154 of the embodiment of the optical acoustic panel 150 of FIG. 1*b*.

The cavity between the first micro perforated foil 110 and a surface 302 closing the cavity has a certain cavity depth $L_2$. The surface 302 is schematically presented as a dashed line. As discussed in the context of FIGS. 1*a* and 1*b*, the surface 302 can be a second micro perforated foil, a surface of a light source or luminaire, or a transparent plate or foil. In specific embodiments the surface 302 is directly applied to the second side of the optical acoustic panel 100 and in that case a length $L_1$ of the light transmitting channels is equal to the cavity depth. In an embodiment, an advantageous sound absorption effect and sound absorption spectrum is obtained by the cavity depth $L_2$ that is in the range from 1 centimeter to 10 centimeters.

The walls 116 of the light the light transmitting cells 106 have a thickness $th_1$. The light transmitting channels 118 of the light transmitting cells 106 have a diameter $d_1$. The light transmitting cells 106 are arranged in a raster structure at a pitch $p_1$. The pitch $p_1$ is a distance between a central point of a light transmitting cell and a central point of a neighboring light transmitting cell. Each light transmitting cell 106 has a length $L_1$ measured in a direction from the first side towards the second side of the optical acoustic panel 100 and, consequently, the light transmitting channels have also the length $L_1$. In an embodiment, the thickness $th_1$ of the walls 116 is smaller than ⅓ of the pitch $p_1$ of the light transmitting cells. In an embodiment, a ratio between the diameter $d_1$ of the light transmitting channels 118 and the length $L_1$ of the light transmitting channels is smaller than 1.7.

Figure 4A:
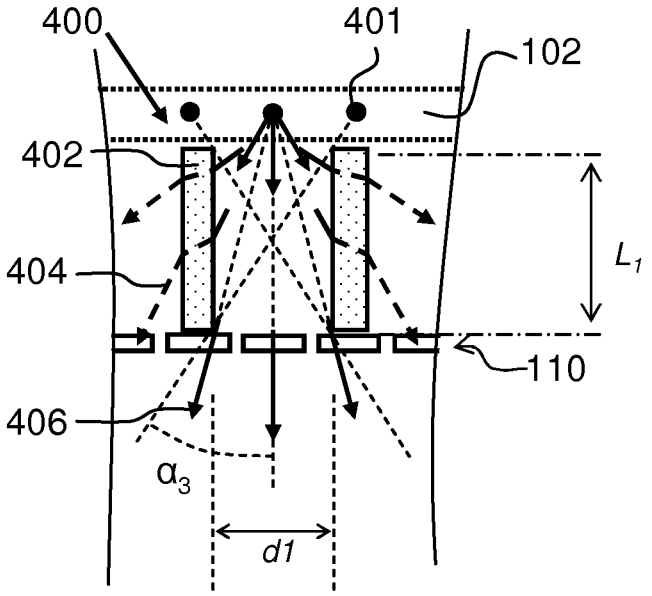

FIG. 4*a* schematically shows a cross-section of an embodiment of a light transmitting cell 400 having blue transparent walls 402. At a light exit window of the light transmitting cell 400 the first micro perforated foil 110 is provided. At a light input window of the light transmitting cell 400 a light source 102 is available. The light source is, in FIG. 4*a*, schematically modeled by point light sources which each emit white light in a relatively wide light emission. A part of the light is collimated and exits the light transmitting channel 400 within a maximum light emission angle $\alpha_3$ with respect to the central axis of the light emission (which is a normal to the first micro perforated foil 110, and, thus, a normal to the first side of the optical acoustic panel). Light ray 406 of white light ends up in the collimated light beam that is being emitted through the light exit window. The angle $\alpha_3$ is determined by a ratio between the diameter $d_1$ of the light transmitting cell and the length $L_1$ of the light transmitting cell. In an embodiment, the angle $\alpha_3$ is smaller than 60 degrees in order to prevent the emission of glary light at larger light emission angles and, thus, is the ratio of the diameter $d_1$ of the light transmitting cell and the length $L_1$ of the light transmitting cell smaller than 1.7.

Light which does not end in the collimated light beam impinges on the blue transparent walls 402. Consequently, this light is partly transmitted through the blue transparent walls 402 and results in blue light rays 404. The light emission angles of the blue light rays 404 is larger than the light emission angle $\alpha_3$.

Figure 4B:
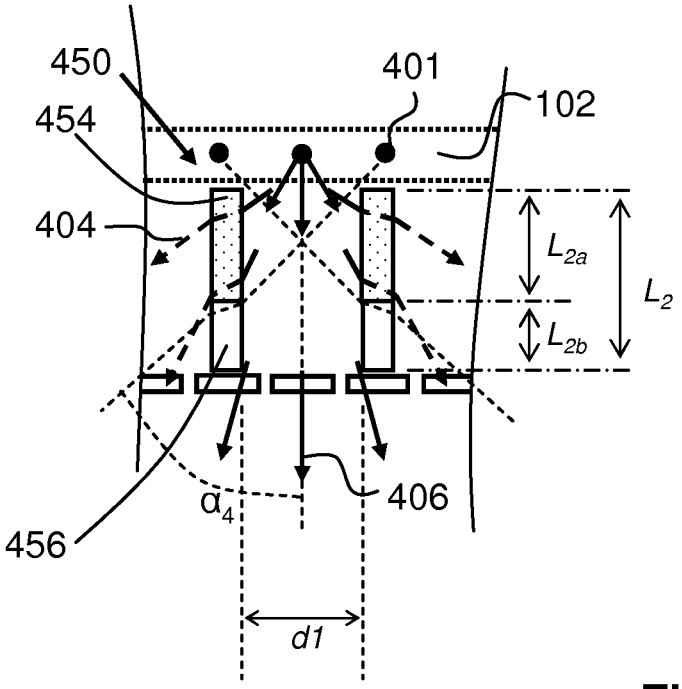

When referring back to FIG. 3, in specific embodiments of the optical acoustic panels, it may be required that the depth $L_2$ of the cavity is relatively large because of acoustic reasons, for example, 8 centimeters. If the length of the light transmitting channels $L_1$ equals the depth $L_2$ of the cavity, and, if white light should be emitted up to a maximum light emission angle of 60 degrees, the ratio between diameter $d_1$ of the light transmitting channels 118 and the length $L_1$ of the light transmitting channels has to be 1.7. Thus, the diameter $d_1$ of the cells has to be 13.6 centimeter, which is relatively large, especially if the light transmitting cells 106 of the spacing structure have to provide mechanical strength to the optical acoustic panel. In order to be able to collimate a light beam of white light with a maximum light emission angle of, for example, 60 degrees, the solution which is presented in FIG. 4*b* is proposed. A specific arrangement of the walls allow the diameter $d_1$ of the light transmitting channels to be reduced, while the depth of the cavity $L_2$ is relatively large compared to the diameter $d_1$ of the light transmitting channels. The walls have a top section 454 which is blue reflective or blue transmissive. The top section 454 is a section of the wall which is arranged at the second side of the optical acoustic panel. A bottom section 456 of the walls is transparent. The bottom section 456 is arranged at the first side of the optical acoustic panel (and, thus, at the side at which the first micro perforated foil 110 is arranged). The maximum light emission angle $\alpha_4$ for the white light is determined by the ratio between the diameter $d_1$ of the light transmitting channel 450 and a length $L_{2a}$ of the top section 454 and is independently of the length $L_{2b}$ of the bottom section 456. Thus, the depth of the cavity $L_2$ may be chosen independently of the maximum light emission angle $\alpha_4$ at which white light has to be emitted. In FIG. 4*b* the top section 454 is assumed to be blue transparent, because the light rays travel through the top section 454 while the non-blue parts are absorbed. In other embodiment, the top section 454 may also be blue reflective.

In an embodiment, the spacing structure is made of a raster of light transmitting cells with transparent walls and the spacing structure is dipped, along a distance $L_{2a}$, into blue paint to create a spacing structure having walls according to the embodiment presented in FIG. 4*b*. The paint may be matte paint to create a blue diffusely reflective top section 454. The paint may also be of a specific material which results in a blue transparent coating at the top section 454 such that a blue transmissive top section is obtained.

In an alternative embodiment (not shown), the stiffness of the optical acoustic panel is increased by providing within the light transmitting cells transparent structures which provide further mechanical support. The transparent structures should not limit the cavity depth ($L_1$ or $L_2$) such that the sound absorption effect is not disturbed. Thus, additional transparent walls (which do not have a color) provided within the light transmitting cells provide an mechanical advantage without changing the optical or acoustic behavior of the optical acoustic panel.

Figure 5A:
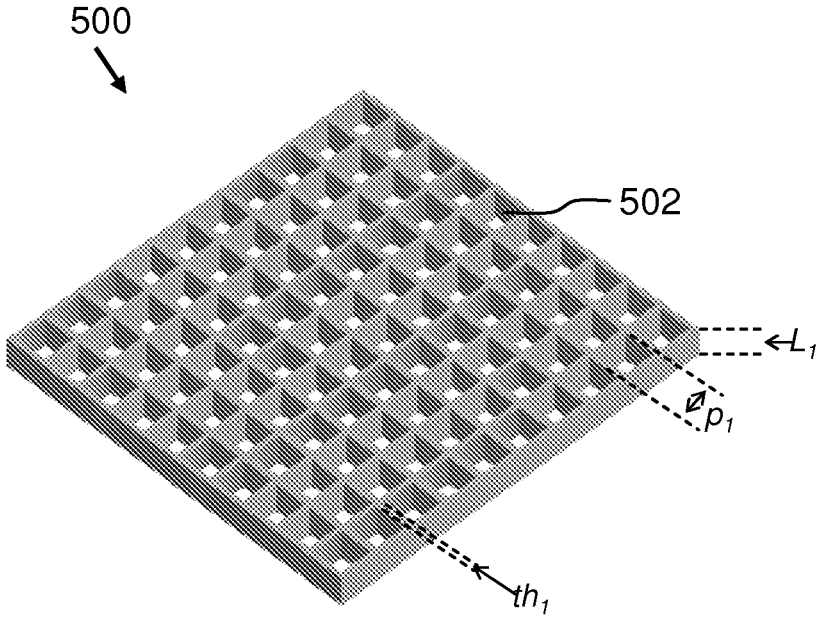
FIGS. 5*a* and 5*b* show three dimensional views of different embodiment of spacing structures, FIGS. 6*a* to 6*c* schematically show cross-sections of three other embodiments of the spacing structures, FIG. 7 schematically shows a cross-section of an embodiment of a luminaire according to the second aspect of the invention, FIG. 8 schematically shows a luminaire according to the invention in use in a room, and FIG. 9 schematically shows an optical acoustic panel according to the invention in use in a room.

FIG. 5*a* presents an embodiment of a spacing structure 500 which comprises a plurality of light transmitting cells 502 in an array. A shape of a cross-section of the light transmitting cells 502 is square. Further, the walls of the light transmitting cells 502 are blue and may be made of a synthetic blue material. The optical element 500 may be manufactured with an injection molding process. Previously discussed parameters of the raster and the light transmitting cells 502, like the pitch $p_1$, the thickness $th_1$ of the walls and the length $L_1$ of the light transmitting channels are indicated as well.

It is to be noted that the walls of the space structure 500 may be transparent, reflective, or diffusely reflective. If the walls are transparent, the viewer sees a more dark blue color at larger viewing angles (defined with respect to a normal to the first side of the optical acoustic element which comprises spacing structure 500) because light rays at these angles are transmitted through a plurality of successive walls and at each wall the blue color is intensified.

Figure 5B:
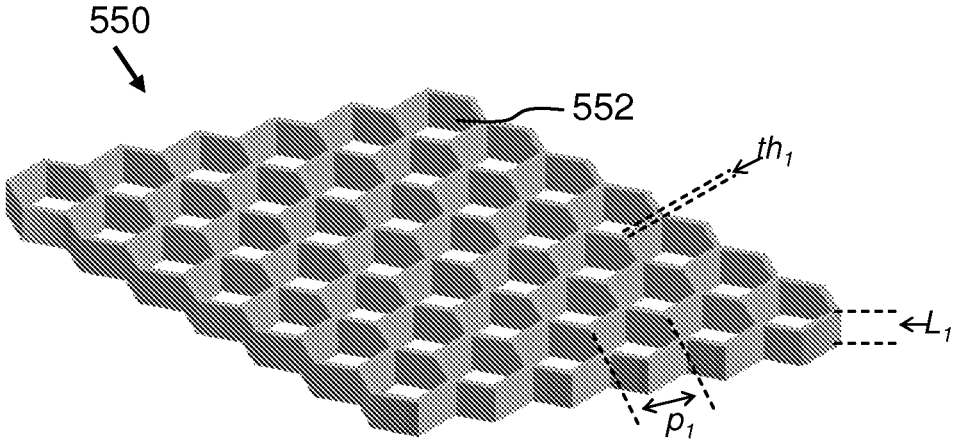

FIG. 5*b* presents an embodiment of another spacing structure 550 which comprises a plurality of light transmitting cells 552 in a raster structure. A shape of a cross-section of the light transmitting cells 552 is hexagonal. Further, the walls of the light transmitting cells 552 are blue and may be made of a synthetic blue material. The optical element 550 may be manufactured with an injection molding process. Previously discussed parameters of the raster and the light transmitting cells 552, like the pitch $p_1$, the thickness $th_1$ of the walls and the length $L_1$ of the light transmitting cells 552 are indicated as well.

In an embodiment (not shown), some of the surfaces of the walls have another color than blue to present an image to a viewer which looks towards the optical acoustic panel which comprises the spacing structure 550. In other words, some cells of the plurality of cells 552 have walls of another color. A viewer which looks, for example, at an angle of 60 degrees towards the optical acoustic panel which comprises the spacing structure 550 mainly sees walls of the cells 552 and does not receive any direct light from a light source because of the relatively large viewing angle. Thus, the viewer sees the different colors of the different colored cells and experiences the combination of them as an image. The image is, for example, an emergency sign indicating an emergency exit, or may be an image of clouds in the sky which enhances the skylight appearance.

In another embodiment (not shown), the walls have a color gradient, for example from white close to the light input window to blue at the light exit window. This creates a smooth transition towards more saturated blue colors when the viewer looks towards the optical acoustic element at larger viewing angles.

Figure 6A:
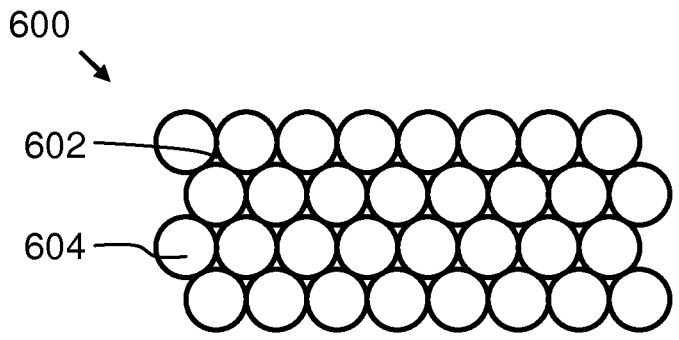
Figure 6B:
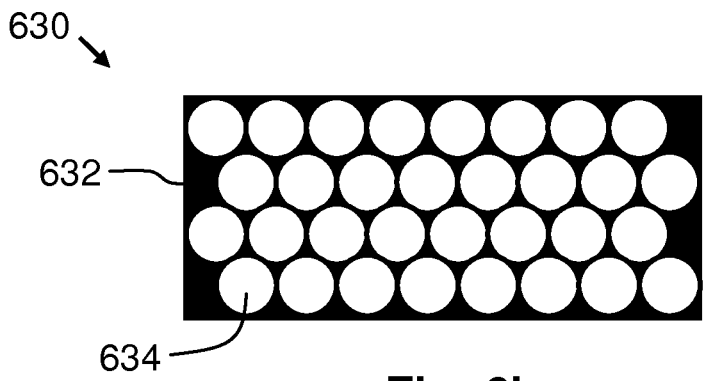
Figure 6C:
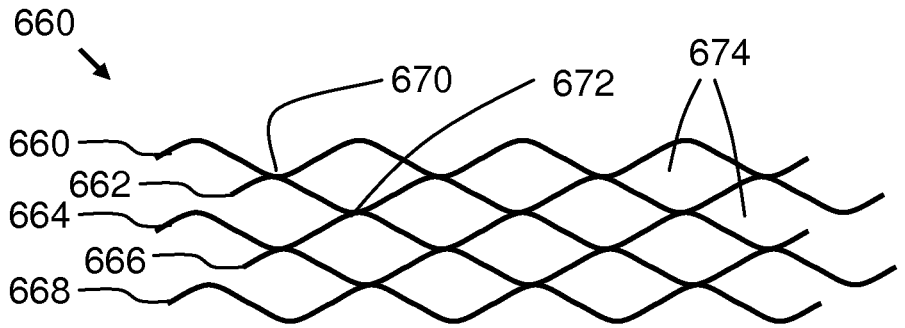

FIGS. 6*a* to 6*c* schematically show cross-sections of three other embodiments of the spacing structures 600, 630, 660. The presented cross-sections are along a plane parallel to the first side of the optical acoustic panel. Spacing structure 600 of FIG. 6*a* comprises a plurality of light transmitting cells 602, 604. The spacing structure 600 may be manufactured by gluing sections of blue pipes together. The inner spaces the sections of pipes become circular shaped light transmitting cells 602 and the spaces in between three neighboring sections of blue pipes become light transmitting cells 604 with another shape. The spaces in between the three neighboring sections may also be filled with a material to prevent light being transmitted through the space. A similar spacing structure is obtained if sections of pipes are used that have, seen in a cross-section, another shape.

FIG. 6*b* presents another cross-section of a further embodiment of a spacing structure 630 which comprises a plurality of light transmitting cells. The spacing structure 600 may be manufactured by drilling holes in a plate 632 of blue synthetic material. The holes form the light transmitting channels 634.

FIG. 6*c* presents a further cross-section of yet another embodiment of a spacing structure 660 which comprises a plurality of light transmitting channels 674 in a raster structure. The spacing structure 660 is manufactured of a stack of blue layers 660, 662, 664, 666, 668. The blue layers 660, 662, 664, 666, 668 may be transparent or diffusely reflective. The spacing structure 600 is manufactured by starting with a first blue layer 660 on top of which a second blue layer 662 is placed. The first blue layer 660 and the second blue layer 662 are locally glued together, as, for example, shown at a position indicated with 670. Thereafter a third blue layer 664 is place on top of the first and second blue layer 660, 662. The third blue layer 664 is locally glued to the second blue layer 662 at specific points which are different from the points at which the first blue layer 660 and the second blue layer 662 are glued together. Such a different position is, for example, indicated with 672. This is repeated with subsequent layers 666, 668. After gluing the successive layers together, the stack of layers is stretched out to obtain the structure of FIG. 6*c*. It is to be noted that the act of stretching out may be performed at another moment in time when the act of gluing the successive layers together is performed, and, as such, the intermediate product of a non-stretched stack of layers has a relatively small volume and may be stored efficiently.

Figure 7:
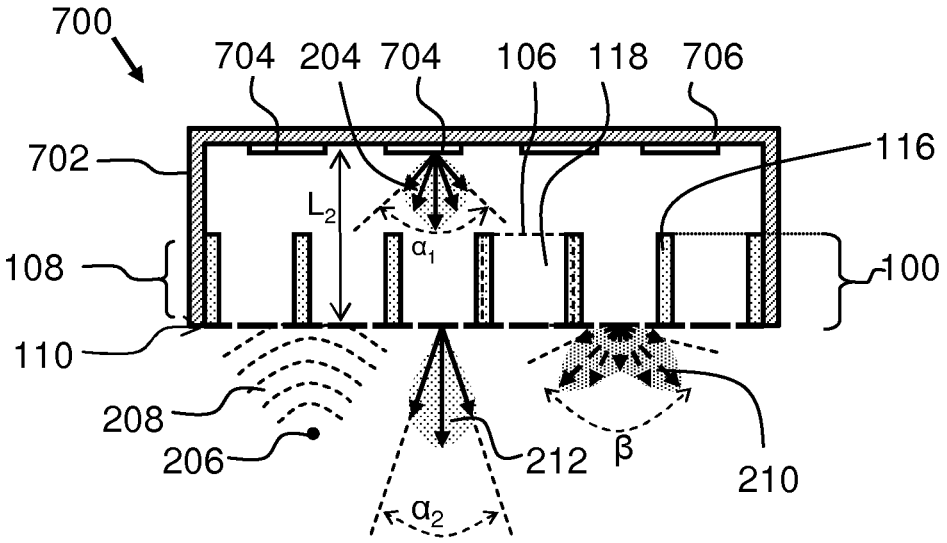

FIG. 7 schematically shows a cross-section of an embodiment of a luminaire 700 according to the second aspect of the invention. The presented cross-section is along a plane that is perpendicular to a light emitting surface of the luminaire 700. The luminaire 700 comprises a housing 702 which encloses a cavity. A plurality of light source 704 are provided within the cavity on a back pane 706 of the housing 702. The light sources 704 may be light-emitting diodes (LEDs), organic LEDs, traditional incandescent lamp, or fluorescent light tubes. The light 204 emitted by the light source 704 is emitted towards an optical acoustic panel 100 which is provided at the position of a light exit window of the housing 702. The optical acoustic panel 100 is similar to the optical acoustic panel 100 of FIG. 1 and comprises a spacing structure 108 and a micro perforated foil 110. The spacing structure comprises a plurality of light transmitting cells 106 which comprise a light transmitting channel 118 in between blue reflective walls 116. The micro perforated foil 110 comprises sub-millimeter holes. The light sources 704 emit light in a relatively wide light beam 204 having a maximum light emission angle $\alpha_1/2$ with respect to a central axis of the light beam 204. The light transmitting channels 118 collimate a part of the light emitted by the light source 704 into a collimated light beam 212 which has a maximum light emission angle $\alpha_2/2$ with respect to a central axis of the light beam 212 and $\alpha_2<\alpha_1$. The walls 116 of the light transmitting channels 118 are diffusely blue reflective and another part of the light from the light sources 704 impinges on the walls 116 and is reflected such that a blue light emission 210 having an angular light emission distribution of a batwing shape is emitted through the micro perforated foil 110. The maximum light emission angle $\beta/2$ of the blue light emission 210 is relatively large an at least larger than $\alpha_2/2$, and larger than $\alpha_1/2$. Sound 208 of a sound source 206 that impinges on the micro perforated foil 110 is absorbed by the combination of the optical acoustic panel 100 and the luminaire 700. Sound travels through the sub-millimeter holes in the cavity in between the back pane 706 of the housing 702 of luminaire 700 and the micro perforated foil 110 and is not transmitted back via the sub-millimeter holes into the ambient. Thus, sound is absorbed by the combination of the optical acoustic panel 100 and the luminaire 700. The depth of the cavity, being the shortest distance from the back pane 706 to the micro perforated foil 110, has a value $L_2$ and is a value in a range from 1 to 10 centimeters. In a specific embodiment, the depth is in a range from 5 to 10 centimeters and is, for example, 8 centimeters. If the cavity has such a depth $L_2$, the absorption of sound is advantageous. The depth influences, for example, the absorption spectrum, and in an office environment it is, for example, advantageous to have an absorption spectrum in the spectral range of sound made by humans (for example, when they are talking with each other). If the cavity depth has the value in the range from 1 to 10 centimeters, the sound of people is well absorbed.

Figure 8:
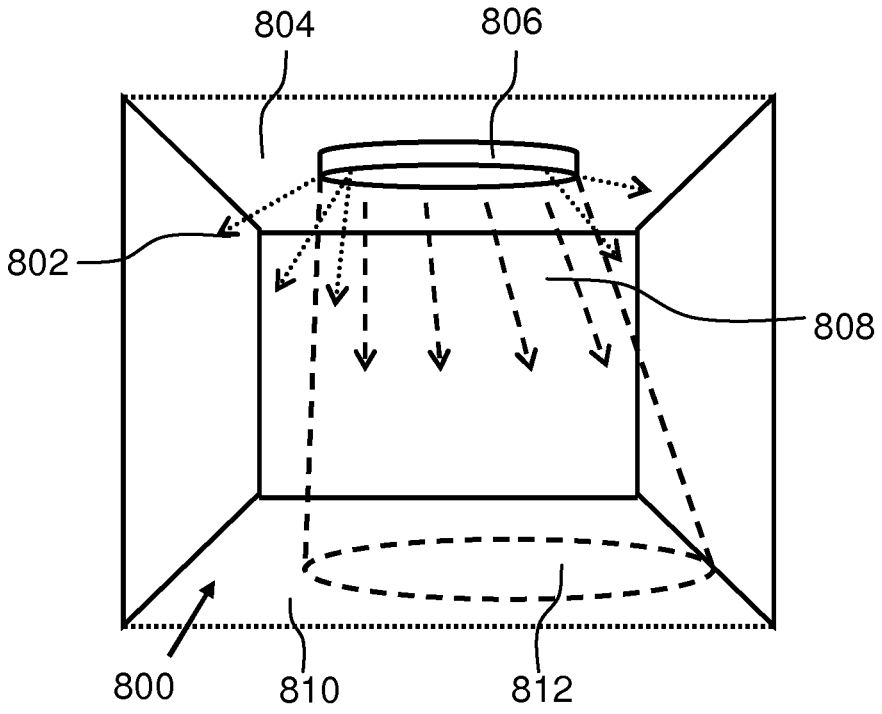

FIG. 8 schematically shows a luminaire 806 in use in a room 800. In FIG. 8 a three dimensional view of the room 800 is schematically presented. At a ceiling 804 of the room 800 is provided the luminaire 806. The luminaire 806 is, for example, based on the design of the luminaire 700 of FIG. 7. The luminaire emits substantially white light in a collimated light beam 808 which has a footprint 812 on the floor 810 of the room 800. At relatively large light emission angles with respect to a normal to the light emitting surface of the luminaire 806 blue light 802 is emitted. Consequently, if a person is present in the room 800 outside the collimated light beam 808, and if the person look towards the luminaire 806, the person sees a blue light emitting surface as if it is the blue sky of a sunny day. Further, the collimated light beam provides an advantageous lighting of the room 800, especially, of a person is working on a desk being arranged within the collimated light beam 808. Further, sound which is generated within the room 800 is to a large extend absorbed by the luminaire 806.

Figure 9:
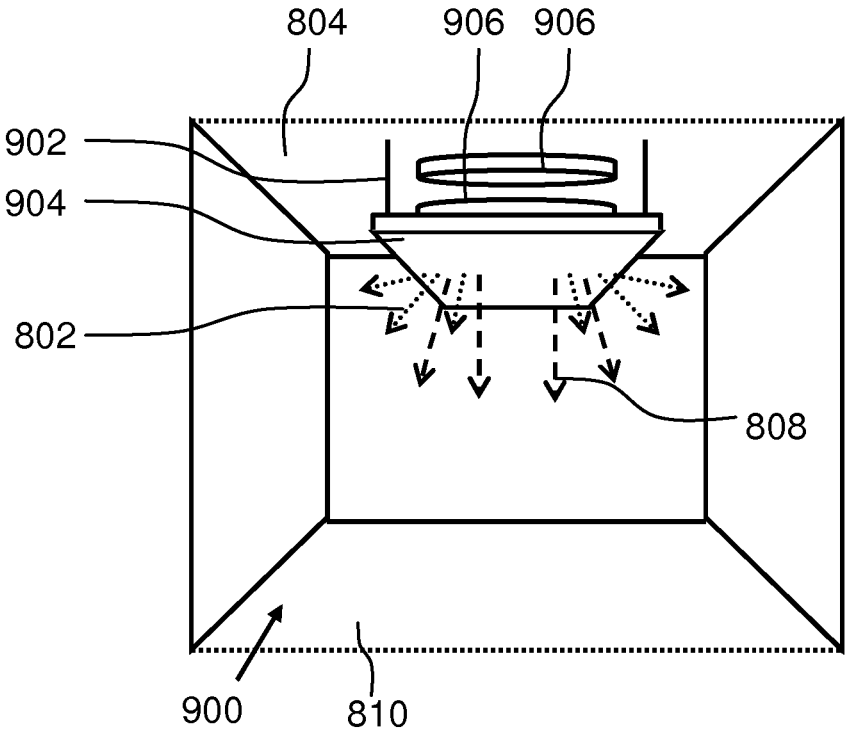

FIG. 9 schematically shows another three dimensional view of an interior of a room 900. A ceiling 804 of room 900 is provided with luminaires 906 which emit white light, or is provided with skylights (not drawn), or for example, light exit windows of light tubes (not shown) which transmit daylight through a roof and plenum of a building. The light sources 906 emit white light in a relatively wide light beam (not shown). This light impinges on the back surface of an optical acoustic panel 904 which is arranged below the light source 906. The optical acoustic panel 904 is suspended to the ceiling with, for example, cables 902, bars or other appropriate suspensions means. The optical acoustic panel 904 has a structure of optical acoustic panel 150 of FIG. 1. Thus, the optical acoustic panel 904 has arranged, at a surface of the optical acoustic panel 904 that is parallel to the ceiling 804, a transparent micro perforated foil. At a bottom surface of the optical acoustic panel 904, which is a surface that is parallel to the ceiling as well and is a surface that is facing the floor 810 of the room 900, another micro perforated foil is provided. In between the two micro perforated foils is arranged a spacing structure in accordance with one of the previously discussed spacing structure embodiments.

The spacing structure of the optical acoustic panel 904 collimates a part of the received light towards a collimated light beam 808 of white light, and generates a blue light emission 802 at relatively large light emission angles with respect to a normal to the bottom surface of the optical acoustic panel. Thus, persons who look towards the optical acoustic panel 904 will see a blue light emitting surface (as if it is the blue sky), and the white light that is transmitted into the room 900 provides an effective and a pleasant lighting of the room 900. Further, the optical acoustic panel 904 absorbs a significant portion of the sound which is generated within the room 900. Thus, the optical acoustic panel 904 has a positive influence on the persons being present in the room 900, because the lighting provided by the optical acoustic panel 904 provides a daylight appearance and absorbs sound. People are positively influence by daylight, and if the amount of sound is limited, people are better able to concentrate and may work more effective and efficient.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. An optical acoustic panel for absorbing sound and providing a daylight appearance, the optical acoustic panel comprising:

a first side for receiving sound, a second side for receiving light, the second side being opposite the first side, a micro perforated foil comprising sub-millimeter holes, the micro perforated foil being light transmitting and being arranged at the first side, the sub-millimeter holes being entrance holes of a cavity, a spacing structure for spacing the first side at a predefined distance from the second side, wherein the spacing structure comprises a plurality of light transmitting cells, the light transmitting cells comprising:

a light transmitting channel for collimating a part of the light received at the second side of the optical acoustic panel, wherein the light transmitting channels extend from the first side towards the second side and are filled with air, a light input window arranged at the second side of the optical acoustic panel, a light exit window, at least a part of the light exit window being arranged at the first side of the optical acoustic panel, a wall interposed between the light input window and the part of the light exit window, the wall enclosing the light transmitting channel, at least a part of the wall being reflective or transmissive in a predefined spectral range for obtaining a blue light emission at relatively large light emission angles with respect to a normal to the first side of the optical acoustic panel, and wherein, a diameter ($d_2$) of the sub-millimeter holes of the micro perforated foil has a value that is within a 15% deviation interval from the thickness ($th_2$) of the micro perforated foil, or wherein, a diameter ($d_2$) of the sub-millimeter holes of the micro perforated foil has a value that is within a 15% deviation interval from the thickness ($th_2$) of the micro perforated foil and the diameter of the sub-millimeter holes of the further micro perforated foil has a value that is within a 15% deviation interval from the thickness of the further micro perforated foil.

2. An optical acoustic panel according to claim 1, comprising a further micro perforated foil comprising sub-millimeter holes, the further micro perforated foil being light transmitting and being arranged at the second side.

3. An optical acoustic panel according to claim 1, wherein a distance between the first side and a surface that closes the cavity is in a range from 1 to 10 centimeter, the distance being measured along a line perpendicular to the first side.

4. An optical acoustic panel according to claim 1 wherein, a ratio between the total area of the micro perforated foil and the area of the sub-millimeter holes of the micro perforated foil is smaller than 0.1, or wherein, a ratio between the total area of the micro perforated foil and the area of the sub-millimeter holes of the micro perforated foil is smaller than 0.1 and a further ratio between the total area of the further micro perforated foil and the area of the sub-millimeter holes of the further micro perforated foil is smaller than 0.1.

5. An optical acoustic panel according to claim 1, wherein the light transmitting cells are arranged in a raster structure, and wherein a thickness ($th_1$) of the walls is smaller than ⅓ of a pitch ($p_1$) of the raster structure, the pitch ($p_1$) of the raster structure being defined by the shortest distance from a center point of a light transmitting channel to a center point of the neighboring light transmitting channel, and the thickness ($th_1$) of the wall being defined as the shortest distance from a surface of the wall facing towards the light transmitting channel to another surface of the wall facing towards a neighboring light transmitting channel.

6. An optical acoustic panel according to claim 1, wherein the optical spacing structure comprises a stretched-out stack of elongated layers, wherein pairs of successive layers are joined together at a plurality of points, successive pairs of successive layers are joined together at different points, the layers form the walls of light transmitting channels, and the light transmitting channels are formed by spaces between two successive layers of the stretched-out stack of elongated layers.

7. An optical acoustic panel according to claim 1, wherein the walls are light transmitting in the predefined spectral range.

8. An optical acoustic panel according to claim 1, wherein a ratio between a diameter ($d_1$) of the light transmitting channel and a length ($L_1$) of the light transmitting channel is smaller than 3.4.

9. A luminaire comprising the optical acoustic panel according to claim 1, wherein the optical acoustic panel is coupled to the luminaire and the second side of the optical acoustic panel is facing the luminaire.

10. A luminaire according to claim 9, wherein a shortest distance between the first side of the optical acoustic panel and a surface of the luminaire which closes the cavity is in a range from 1 to 10 centimeter.

11. An optical acoustic panel for absorbing sound and providing a daylight appearance, the optical acoustic panel comprising:

a first side for receiving sound, a second side for receiving light, the second side being opposite the first side, a micro perforated foil comprising sub-millimeter holes, the micro perforated foil being light transmitting and being arranged at the first side, the sub-millimeter holes being entrance holes of a cavity, a spacing structure for spacing the first side at a predefined distance from the second side, wherein the spacing structure comprises a plurality of light transmitting cells, the light transmitting cells comprising:

a light transmitting channel for collimating a part of the light received at the second side of the optical acoustic panel, wherein the light transmitting channels extend from the first side towards the second side and are filled with air, a light input window arranged at the second side of the optical acoustic panel, a light exit window, at least a part of the light exit window being arranged at the first side of the optical acoustic panel, a wall interposed between the light input window and the part of the light exit window, the wall enclosing the light transmitting channel, at least a part of the wall being reflective or transmissive in a predefined spectral range for obtaining a blue light emission at relatively large light emission angles with respect to a normal to the first side of the optical acoustic panel, and wherein a surface of the walls facing towards the light transmitting channel is diffusely reflective in the predefined spectral range.

12. An optical acoustic panel for absorbing sound and providing a daylight appearance, the optical acoustic panel comprising:

a first side for receiving sound, a second side for receiving light, the second side being opposite the first side, a micro perforated foil comprising sub-millimeter holes, the micro perforated foil being light transmitting and being arranged at the first side, the sub-millimeter holes being entrance holes of a cavity, a spacing structure for spacing the first side at a predefined distance from the second side, wherein the spacing structure comprises a plurality of light transmitting cells, the light transmitting cells comprising:

a light transmitting channel for collimating a part of the light received at the second side of the optical acoustic panel, wherein the light transmitting channels extend from the first side towards the second side and are filled with air, a light input window arranged at the second side of the optical acoustic panel, a light exit window, at least a part of the light exit window being arranged at the first side of the optical acoustic panel, a wall interposed between the light input window and the part of the light exit window, the wall enclosing the light transmitting channel, at least a part of the wall being reflective or transmissive in a predefined spectral range for obtaining a blue light emission at relatively large light emission angles with respect to a normal to the first side of the optical acoustic panel, and wherein a first part of the walls of the light transmitting cells is reflective or transmissive in the predefined spectral range in an area from the second side of the optical acoustic panel along a specific distance towards the first side of the optical acoustic panel to obtain a substantial blue light emission at light emission angles larger than 60 degrees, the light emission angles being measured with respect to the normal to the first side of the optical acoustic panel, and wherein a second part of the walls is transparent, the second part being different from the first part.

* * * * *